US006494612B2

(12) United States Patent
Johanson

(10) Patent No.: US 6,494,612 B2
(45) Date of Patent: Dec. 17, 2002

(54) RACETRACK-SHAPED DYNAMIC GRAVITY FLOW BLENDER

(75) Inventor: Jerry R. Johanson, San Luis Obispo, CA (US)

(73) Assignee: JR Johanson, Inc., San Luis Obispo, CA (US)

( * ) Notice: Subject to any disclaimer, the term of this patent is extended or adjusted under 35 U.S.C. 154(b) by 0 days.

(21) Appl. No.: 09/805,749

(22) Filed: Mar. 13, 2001

(65) Prior Publication Data

US 2002/0159329 A1 Oct. 31, 2002

Related U.S. Application Data

(60) Provisional application No. 60/230,735, filed on Sep. 7, 2000.

(51) Int. Cl.[7] ..... B01F 5/24; B01F 9/02

(52) U.S. Cl. ..... 366/228; 366/235; 366/341

(58) Field of Search ..... 366/9, 220, 225, 366/228, 235, 341; 222/459

(56) References Cited

U.S. PATENT DOCUMENTS

| | | | | |
|---|---|---|---|---|
| 1,731,675 | A | * | 10/1929 | McCoy |
| 2,138,550 | A | * | 11/1938 | MacLellan |
| 3,081,009 | A | * | 3/1963 | Cooper |
| 3,536,303 | A | * | 10/1970 | Johanson |
| 4,286,883 | A | * | 9/1981 | Johanson |
| 4,358,207 | A | * | 11/1982 | Roth |
| 4,548,342 | A | * | 10/1985 | Fisher |
| 4,775,242 | A | * | 10/1988 | Bohle |
| 4,923,304 | A | * | 5/1990 | Jackson et al. |
| 4,958,741 | A | * | 9/1990 | Johanson |
| 5,248,197 | A | * | 9/1993 | Storf et al. |
| 5,462,351 | A | * | 10/1995 | Royal |
| 5,500,083 | A | * | 3/1996 | Johanson |
| 5,700,355 | A | * | 12/1997 | Prough |
| 6,102,562 | A | * | 8/2000 | Bengtson |

FOREIGN PATENT DOCUMENTS

| | | | |
|---|---|---|---|
| DE | 3401687 | * | 7/1985 |
| EP | 530556 | * | 3/1993 |
| GB | 1523404 | * | 8/1978 |

* cited by examiner

*Primary Examiner*—Charles E. Cooley
(74) *Attorney, Agent, or Firm*—Thomas F. Lebens; Sinsheimer, Schiebelhut & Baggett

(57) ABSTRACT

Apparatus for blending particulate solids or liquids includes a blending vessel having a racetrack-shaped cross section at each elevation above its lower end. The racetrack-shaped cross section consists of two spaced opposed semicircles having ends that are joined by two spaced parallel line segments. Several embodiments of the apparatus are described; they all employ the racetrack-shaped blending vessel, which is highly effective in promoting mixing. In one embodiment the racetrack-shaped blending vessel is rotated about a horizontal axis so that the material passes through the vessel on each revolution. In another embodiment, a number of racetrack-shaped blending vessels are connected in a vertical sequence so that the material must pass through the blending vessels in succession.

6 Claims, 5 Drawing Sheets

RACETRACK-SHAPED DYNAMIC GRAVITY FLOW BLENDER

REFERENCE TO EARLIER APPLICATION

This application claims the benefit of U.S. Provisional Application No. 60/230,735 filed Sep. 7, 2000.

BACKGROUND OF THE INVENTION

Blending of materials (liquids or solid particles) usually relies on mechanical means of moving one portion of the material with respect to another portion thus distributing streams of solids with respect to each other. The better mixers will frequently change relative movement direction to produce a crosswise reverse motion of the material. Usually mechanical impellers of various shapes are used, including mechanically activated ribbons and paddles. In some blenders, a series of stationary paddles are used and the material is allowed to drop through the paddles and thus produce a sequence of cuts and deflections of the stream in various directions to produce a mixing action. Sometimes the mechanical impellers are moved fast enough to throw the material. While this sometimes improves mixing, it often degrades the material and consequently does not produce a satisfactory mixing process.

SUMMARY OF THE INVENTION

The blender of the present invention has a particular shape defined by the following features. At each elevation above the discharge opening, the cross section of the blender in any plane perpendicular to the axis of symmetry of the blender is racetrack-shaped; that is, the cross section consists of two opposed semicircles, spaced, and with their concave sides facing each other, the ends of the semicircles joined by parallel straight lines, resulting in a shape resembling that of a racetrack. The resulting blender necessarily has an axis of symmetry.

If the diameters of the semicircles are the same at all elevations, then the flat surfaces generated by the parallel straight lines will be vertical. On the other hand, if the diameters of the semicircles increase with increasing elevation, then the flat surfaces generated by the parallel straight lines converge downwardly. These two cases are illustrated, respectively, by the lower and the upper portions of the blender shown in FIGS. 1A through 1C. In both cases, the resulting structure is said to have one-dimensional convergence. In some embodiments described below, more than one blender module of this basic shape are combined in cascade, as shown in FIGS. 3A and 3B.

With the present invention, materials are mixed as they flow by gravity through a blending vessel of racetrack configuration and strike its multiple surfaces. The multiple surfaces of the blending vessel walls cause the material to disperse as it strikes the straight part of the racetrack. The curved portions of the racetrack then force this dispersed material back together, thus causing blending. The blending is enhanced when the blending vessel is designed to cause convergence of the material in only one direction at a time. Generally these directions are perpendicular to each other so that dispersion and mixing occur first in one direction and then in a direction perpendicular to the first. This one-dimensional convergence is not only useful to enhance blending, but also can produce bottom to top sequential discharge of material leaving the blending vessel.

The means for introducing material into the racetrack configuration blending vessel can be as simple as a single chute, or multiple feeders feeding multiple chutes.

In a simple, non-rotating embodiment, multiple blending opportunities are provided by stacking blending vessels and allowing material to fall by gravity from one vessel into the next, as in FIGS. 3A and 3B.

In another embodiment, shown in FIGS. 4A through 4C, a large closed introduction chamber affixed to the top of the blending vessel is alternately filled and emptied by gravity as the blending vessel and chamber are rotated as a unit about a horizontal axis. This configuration, in which the ends of both the blending vessel and the chamber are capped so as to contain the material, allows for the repeated entry of the same material into the same blending vessel as the assembly is rotated about a horizontal axis.

The multiple blending opportunities off the rotated embodiment are enhanced when the introduction chamber has the same size and shape as the blending vessel and is mounted in an inverted posture into the upper end off the blending vessel, as shown in FIGS. 5A through 5B. This provides a mixing opportunity with each half revolution. Blending in this dual racetrack-shaped blender configuration is further enhanced by a go-degree rotation of the racetrack axis of one blending vessel with respect to the other.

BRIEF DESCRIPTION OF THE DRAWINGS

FIG. 1A is a front elevational view of the blender;

FIG. 1B is a top plan view of the blender with intersecting areas of the chute outlet and the blender outlet for more effective mixing. The one-dimensional convergence of the blender walls is readily apparent.

FIG. 1C is a side elevational view of the blender.

FIG. 2A is a front elevational view showing the spreading of the material as it impacts the upper flat sloping portion of the blending vessel's racetrack configuration. Also shown is the further change of velocity, material dispersion, and mixing as the material impacts the lower concave portion of the blending vessel's racetrack configuration. The figure shows the final mixing of the fully dispersed material as it exits the blending vessel's final racetrack configuration.

FIG. 2B is a side elevational view of the blender apparatus showing how some material immediately contacts the upper straight portion of the racetrack configuration while some material completely misses this portion and is propelled into the material sliding off of the upper flat racetrack portion, which produces a significant mixing of the dispersed material. The figure also shows how some of the material impacts onto the far side of the lower flat portion of the blending vessel's racetrack configuration. This material deflects back into the material sliding along the concave portion of the blending vessel's racetrack configuration.

FIG. 3A shows a front elevational view of the blending vessels;

FIG. 3B shows a side elevational view of the blending vessels;

FIG. 4A is a front elevational view of the assembly and shows a means of closing off the bottom of the blending vessel for a time so that the material can be recycled to the top of the blender by rotating the entire assembly about a horizontal axis. This allows the material to flow by gravity into the closed introduction chamber and to be re-circulated again into the blending vessel as the rotation continues.

FIG. 4B is a top plan view of the blending vessel, the introduction chamber and the rotation mechanism. The axis of the rotation is intentionally offset from the racetrack axis to improve the mixing in the blending vessel.

FIG. 4C is a side elevational view of the assembly.

FIG. 5A is a front elevational view of the assembly.

FIG. 5B is a top plan view of the assembly and shows that the axes of the racetracks of the vessels are offset by about 90 degrees to improve the blending as material is dropped from one vessel into the other as the assembly is rotated about a horizontal axis.

FIG. 5C is a side elevational view of the assembly.

DETAILED DESCRIPTION OF THE PREFERRED EMBODIMENT

Figure 1B:
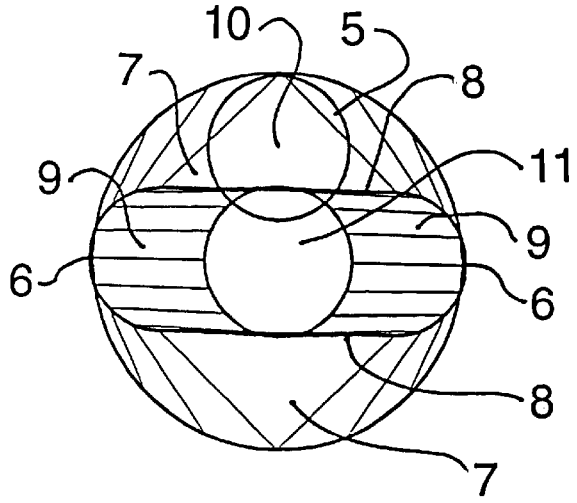
FIGS. 1A, 1B and 1C, show the racetrack shape of the blender and a chute that introduces the material to the blender.
Figure 1A:
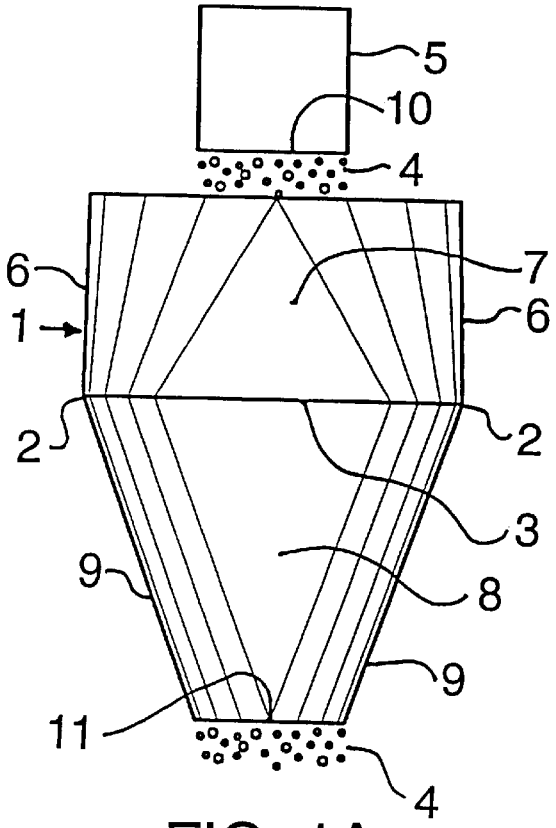

FIG. 1A illustrates the basic invention and shows a blending vessel in which each cross-section is a racetrack configuration composed of opposing semicircular end sections 2 and opposing straight parallel lines 3. Material to be blended is introduced into the vessel 1 by means of a chute 5 in such a manner that the material strikes the multiple surfaces of the vessel walls in such a way as to cause a variation of the progression velocity through the blending vessel, and to cause an interparticle dispersion of the material stream.

Figure 1C:
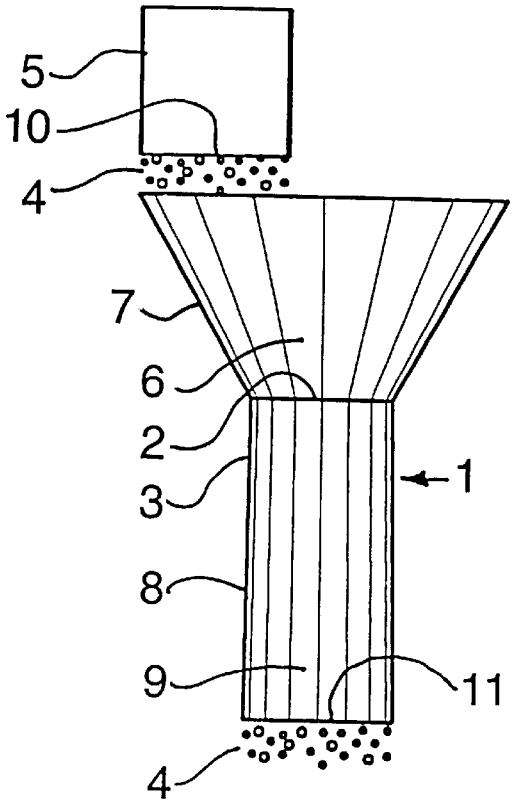

This dispersion is enhanced when the curved walls 6 and flat walls 7 of the racetrack configuration are arranged so that they converge in one direction at a time. For example, in the upper part of the blending vessel, curved walls 6 remain equidistant while flat walls 7 converge in the downward direction of FIG. 1A, as seen in FIG. 1C and in the plan view of the apparatus in FIG. 1B. In the lower part of the blending vessel, the condition is reversed so that the straight portions of the racetrack forming flat walls 8 remain parallel while the curved portions of the racetrack forming walls 9 converge in the downward direction of FIG. 1A and FIG. 1C. This structure illustrates what is called one-dimensional convergence because only one dimension of the vessel walls converges at any given cross-section of the vessel. This one-dimensional convergence is especially effective for bleeding when the first convergent direction is the flat walls 7 of the upper part of the blending vessel of FIGS. 1A through 1C followed by the convergence of the curved walls 9 of the lower part of the blending vessel of FIGS. 1A through 1C. One-dimensional convergence can also provide a bottom-to-top discharge of solids when the blending vessel is full and then emptied, provided the walls are steep enough.

Figure 2A:
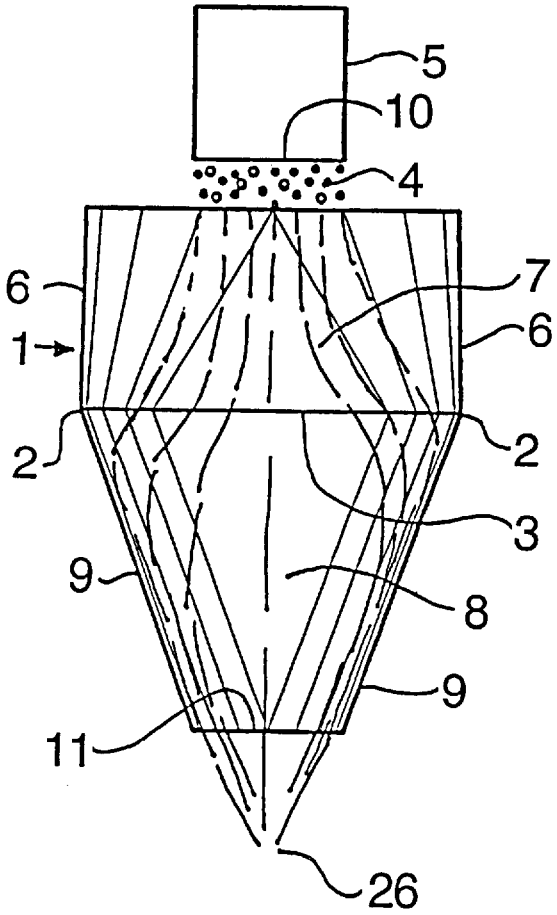
FIG. 2A and FIG. 2B illustrate the dynamic interaction of the multifaceted wails of the blending vessel with the material introduced by the chute.
Figure 2B:
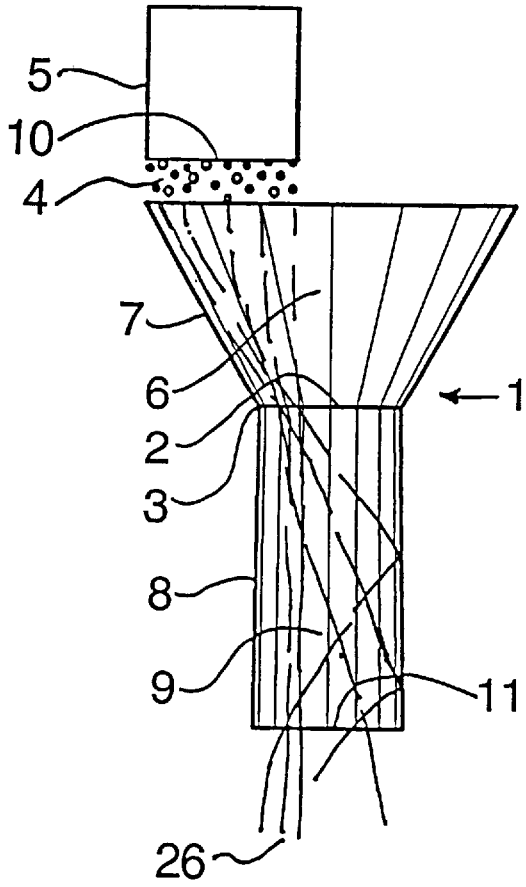

One means of increasing material dispersion is shown in FIGS. 1C and 1B, where the chute 5 is located so that outlet 10 of the chute 5 and the outlet 11 of the blending vessel partially overlap. This allows some of the material to immediately reach the outlet 11 and interact with other material that has been delayed by interaction with the sloping walls. The dispersion achieved by the apparatus of FIGS. 1A through 1C is described pictorially in FIG. 2A and FIG. 2B. The trajectories of a number of particles 4 are indicated by flow lines. As the particles 4 leave the chute 5 the velocity is small and essentially vertical. The material near the wall 7 strikes the wall soon after exiting the chute 5 while the material furthest away from the wall 7 might never stride the wall 7 but instead might fall freely as it descends to the outlet 11. The material that does not strike the wall 7 interacts with the material sliding off the wall 7 in the vicinity of the intersection between walls 7 and 8 as seen in FIG. 2B. FIG. 2A illustrates how particles 4 from chute 5 disperse to the side as they strike the flat part 7 of he racetrack wall. As a result of this lateral dispersal, the material strikes the circular portion 9 of the wall at various vertical positions and velocities. The circular portion of the wall directs the dispersed material back together, thus causing mixing. Dispersion occurs again as the material accelerates on the curved wall 9 toward the outlet. FIG. 2B shows some of the material striking the wall 8 and being deflected back into the dispersed stream of material, either falling freely or sliding on the curved wall 9.

Figure 3A:
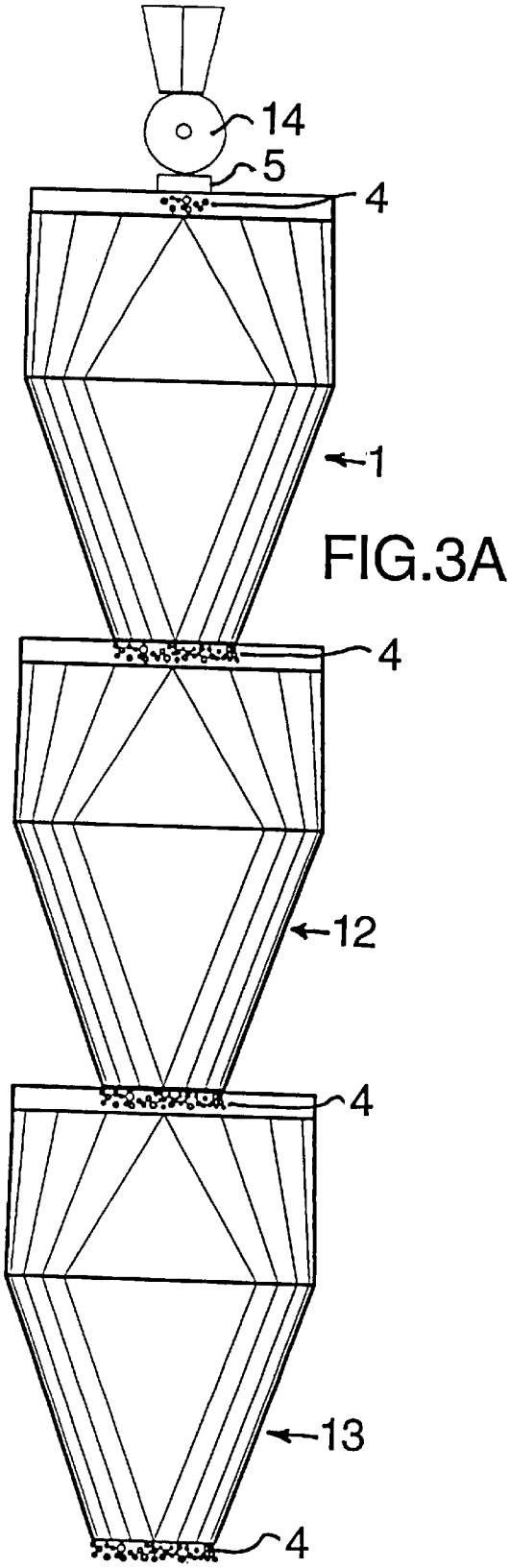
FIG. 3A and FIG. 3B show a series of three blending vessels, one above the other. The figure also shows multiple feeders and their associated chutes introducing two or more materials for mixing in the blending vessel.
Figure 3B:
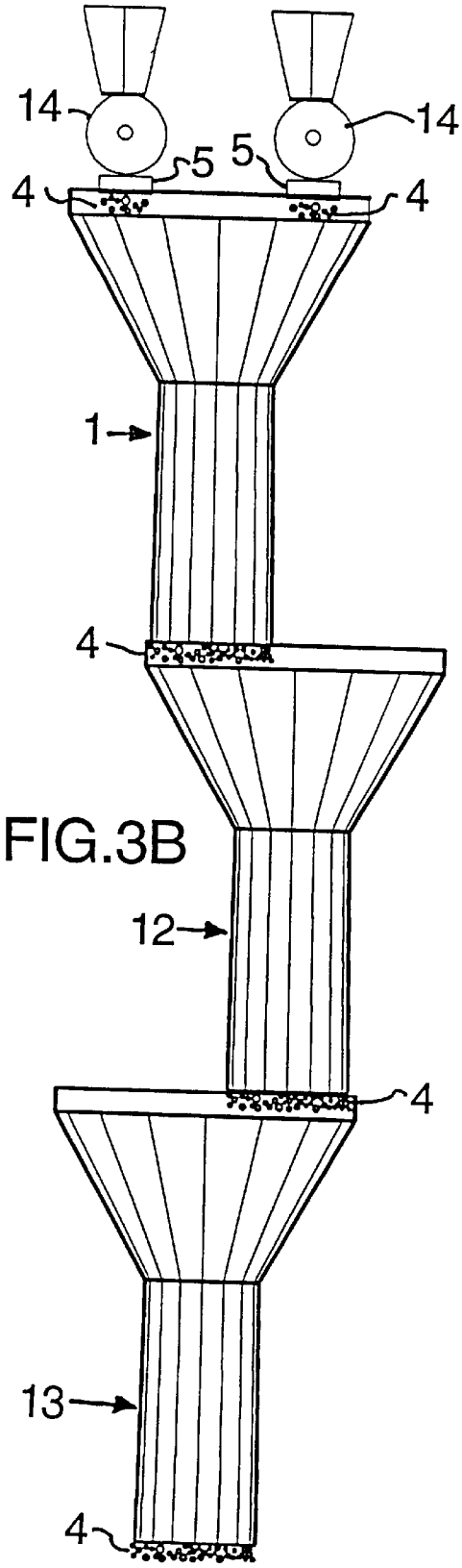

FIGS. 3A and 3B show a series of similar blending vessels 1, 12 and 13, each lower blending vessel receiving material 4 from the blending vessel immediately above it. FIGS. 3A and 3B also shows multiple chutes 5 fed with feeders 14 to introduce multiple materials into the blender.

Figure 4B:
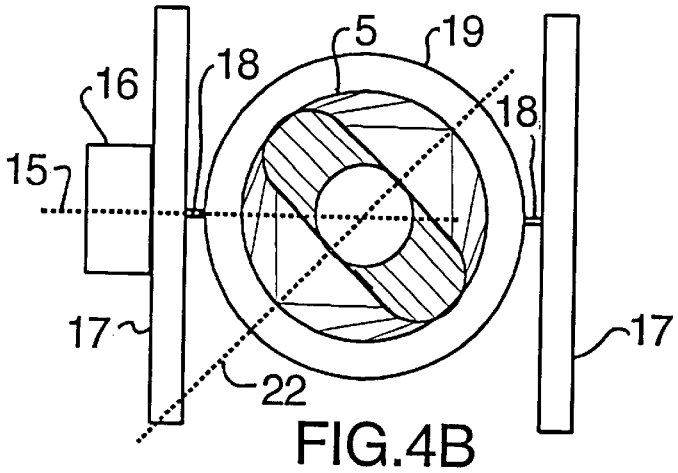
FIG. 4A, FIG. 4B and FIG. 4C show the blending vessel with an introduction chamber that has a diameters essentially the same as the top of the blending vessel.
Figure 4A:
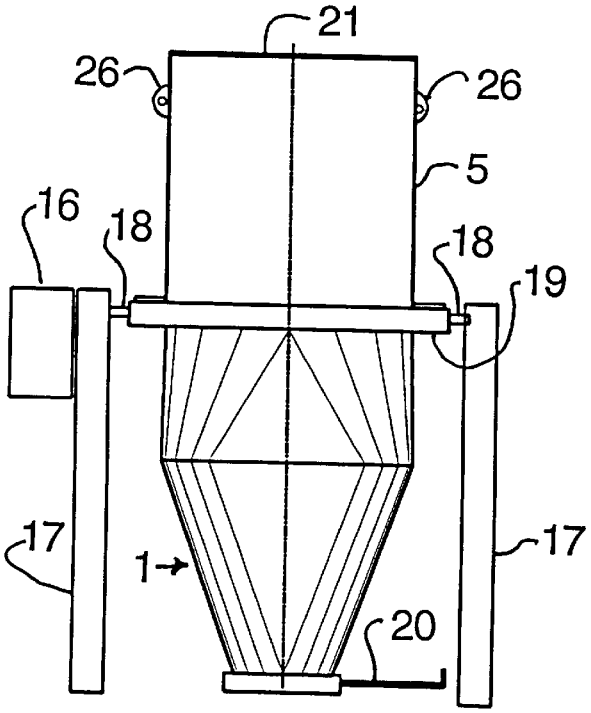
Figure 4C:
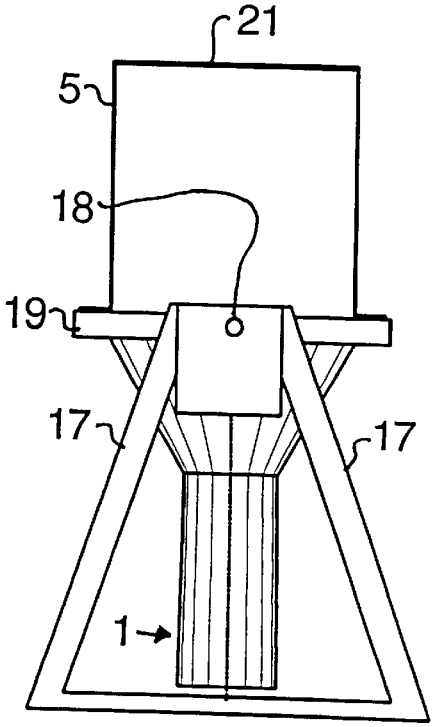

FIGS. 4A through 4C show the blending apparatus with a cylindrical introduction chamber 5 introducing material into the blending vessel 1. The diameter of the introduction chamber 5 equals the diameter of the top of the blending vessel 1. The introduction chamber 5 is attached to the upper end of the blending vessel and is closed off by a top 21. The chamber 5 is tilled intermittently as the assembly is rotated about a horizontal axis 15 by a motor 16 supported by al frame 17. The blending vessel 1 and chamber 5 assembly are secured to the rotating motor shaft 18 by a support ring 19. The discharge opening of the blending vessel is closed off by the gate 20, thus allowing the blending cycle to repeat on each revolution lifting lugs 26 allow the blending vessel and chamber to be lifted from the rotational mechanism.

Blending in the blending vessel of FIGS. 4A through 4C is improved when the major axis 22 of the racetrack is oriented at an angle with respect to the axis of rotation 15, as shown in FIG. 4B. The best results are obtained when that angle is approximately 45 degrees, however less than or greater than 45 degrees is also helpful.

Figure 5B:
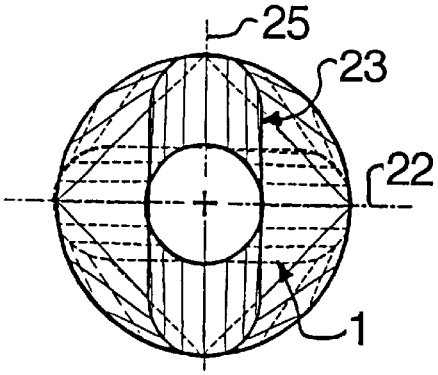
FIG. 5A, FIG. 5B, and FIG. 5C show a blending vessel and introduction chamber in which the introduction chamber is identical to the blending vessel and is separated from, but connected to, the blending vessel by a cylinder.
Figure 5A:
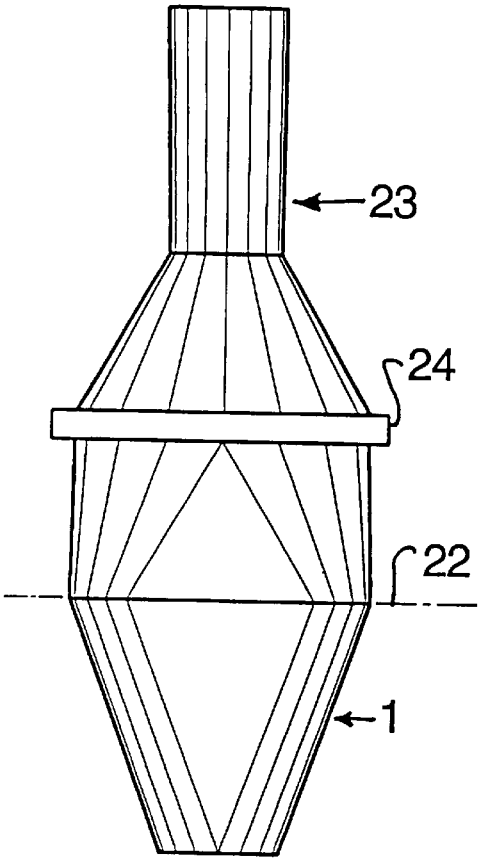
Figure 5C:
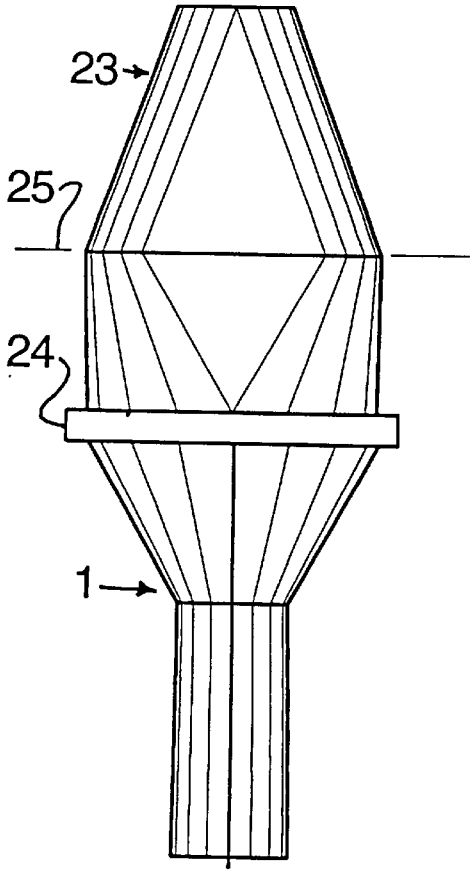

Because most of the blending occurs in the blending vessel 1, the shape of the chute 5 of FIGS. 1 and 2 and of the cylindrical chamber 5 of FIGS. 4A through 4C is not important. It could be a cylinder, a cone, or another blending vessel 23 identical to the blending vessel 1, as shown in FIGS. 5A through 5C. The embodiment of FIGS. 5A through 5C produces blending on each half rotation of the assembly. This it especially effective when the two vessels 1 and 23 are situated, as shown in FIGS. 5A through 5C, so that the major axes 22 and 25 of the racetracks are oriented at about 90 degrees from each other, as seen in the plan view of FIG. 5B. The two vessels are shown separated from each other by a short cylindrical transition 24. While this separation is not essential, it does help increase the effective volume of the blender and increases the dynamic mixing effects discussed above.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A blending apparatus comprising:

blending vessel having an axis of symmetry and at all points along the axis of symmetry having a racetrack-shaped cross section in a plane perpendicular to the axis of symmetry, said racetrack-shaped cross section consisting of two opposed semicircles, spaced, and with their concave sides facing each other, the ends of the semicircles joined by parallel straight line segments, said blending vessel extending downward from an upper end to a lower end; and means for rotating said blending vessel about an approximately horizontal axis, the rotating means operably attached to said blending vessel, wherein the major axis of the racetrack-shaped cross sections of said blending vessel is oriented in a different direction from the direction of said approximately horizontal axis about which said blending vessel is rotated.

2. The blending apparatus of claim 1 in which the major axis is displaced in angle from the horizontal axis by an amount between 15 and 75 degrees.

3. The blending apparatus of claim 1 further comprising an introduction vessel for receiving and holding the material as the blending vessel is rotated to an inverted position, and for re-introducing the material to the blending vessel as the blending vessel is rotated to an upright position, said introduction vessel having a lower end connected to the upper end of the blending vessel and having an upper end.

4. The blending apparatus of claim 3 wherein said introduction vessel is cylindrical shaped, and is closed at its upper end.

5. The blending apparatus of claim 3 wherein said introduction vessel is a vessel identical in size and shape to said blending vessel and is joined to said blending vessel in an inverted posture.

6. The blending apparatus of claim 5 wherein said introduction vessel is joined to said blending vessel with the major axis of a racetrack-shaped cross section of said introduction vessel oriented at a different direction from the major axis of the racetrack-shaped cross section of said blending vessel.

* * * * *